United States Patent [19]

Göpfert

[11] Patent Number: 4,787,812

[45] Date of Patent: Nov. 29, 1988

[54] APPARATUS FOR LIFTING ARRAYS OF PAVING STONES AND THE LIKE

[76] Inventor: Reinhard Göpfert, Hannoversche Str. 156, D-3070 Nienbyrg, Fed. Rep. of Germany

[21] Appl. No.: 583,048

[22] Filed: Feb. 23, 1984

[30] Foreign Application Priority Data

| | | | |
|---|---|---|---|
| Feb. 24, 1983 | [DE] | Fed. Rep. of Germany | 3306351 |
| Jul. 7, 1983 | [DE] | Fed. Rep. of Germany | 3324441 |
| Nov. 24, 1983 | [DE] | Fed. Rep. of Germany | 3342424 |

[51] Int. Cl.[4] ..... E01C 5/00

[52] U.S. Cl. ..... 414/737; 294/65; 294/64.1

[58] Field of Search ..... 414/736, 737, 687; 901/40; 294/87 A, 64 R, 65

[56] References Cited

U.S. PATENT DOCUMENTS

| | | | |
|---|---|---|---|
| 2,681,757 | 6/1954 | Kellersman | 414/737 X |
| 2,840,415 | 6/1958 | Morris | 294/65 |
| 3,139,300 | 6/1964 | Hirt | 294/65 |
| 3,152,828 | 10/1964 | Lytle | 294/64 |
| 3,549,031 | 12/1970 | Blood et al. | 414/737 |
| 3,637,092 | 1/1972 | George et al. | 901/40 X |
| 3,920,128 | 11/1975 | Baker | 414/737 |
| 4,078,671 | 3/1978 | Lundstrom | 901/40 X |

FOREIGN PATENT DOCUMENTS

| | | | |
|---|---|---|---|
| 53-140760 | 8/1978 | Japan | 294/65 |
| 81658 | 9/1979 | Luxembourg | 414/737 |
| 7215130 | 5/1974 | Netherlands | 414/737 |
| 445546 | 9/1965 | Switzerland | 414/737 |

*Primary Examiner*—Carlton R. Croyle
*Assistant Examiner*—Theodore Olds
*Attorney, Agent, or Firm*—Peter K. Kontler

[57] ABSTRACT

A self-propelled apparatus for lifting arrays of paving stones has a mobile arm one end of which carries a support for a polygonal assembly of suction cups having axially and angularly movable bellows which attract the paving stones of an array during transport. The support further carries directional jaws which are adjacent to the sides of the polygonal assembly of suction cups and are movable relative to the support to rearrange the paving stones of an array if the distribution of paving stones departs from an optimum distribution. The jaws are moved out of the way before the suction cups deposit the paving stones of an array so that a freshly deposited array can be placed into immediate or close proximity of the previously deposited array or arrays.

22 Claims, 16 Drawing Sheets

APPARATUS FOR LIFTING ARRAYS OF PAVING STONES AND THE LIKE

Figure 1:
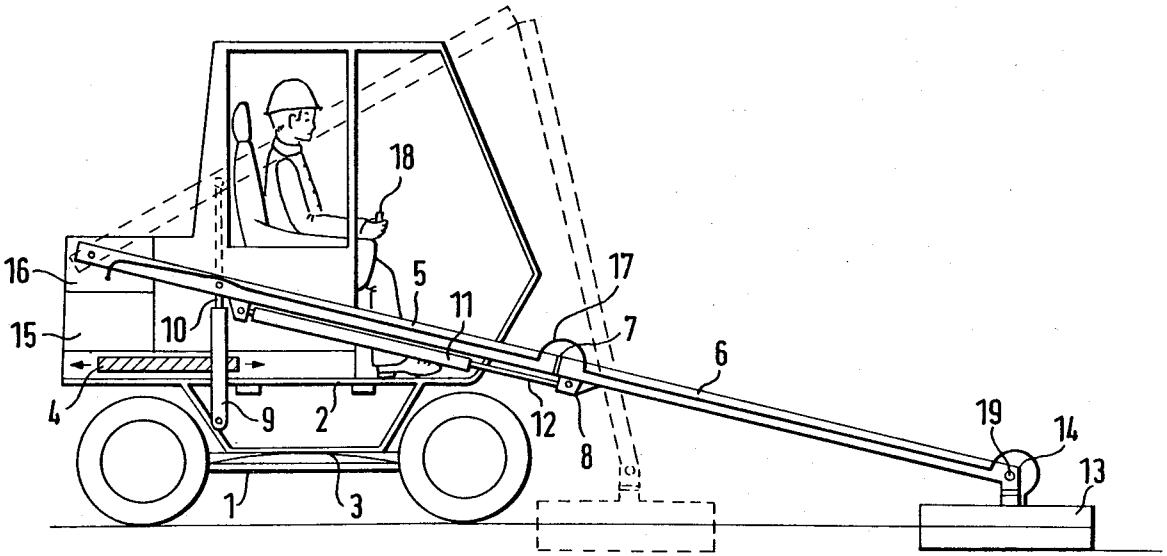

The invention relates to self-propelled equipment with a mobile framework and a suction lifting device fastened to at least one position-adjustable crane jib for the lifting and laying of transportable normal concrete components, in particular for the laying of commercially available concrete-,clinker brick- and natural stone-paving setts.

For the laying of unit paving setts, equipment is already known for use which has a mobile framework and an articulated jib mounted on it which may be raised or lowered vertically and which has a device attached to the free end of the jib for gripping the unit paving setts. In this case the jib is articulated with the rear end of the mobile framework and it is extended to the front over the driver's seat which is located at the front end of the mobile framework. The paving setts can be picked up in layers by the grab and by moving the equipment they can be transported and set down again. The grab which is rotatably articulated with the crane jib can only be raised or lowered. For slewing around, that is to say to change the direction, the whole of the equipment with the mobile framework must be swung around with maximum angle of turn of the wheels and appropriate steering into the new position for the laying of the setts. This causes the grab which has a single-point suspension, as already mentioned, to sway from side to side to such an extent that it is necessary to wait each time a turn is made until the pendulum action stops before the load can be set down. This also occurs each time before the block layers are picked up from storage on the delivery pallets. so that every laying operation is accompanied by a great deal of wasted time.

In addition to this the building components can only be moved in the forward direction of travel for transportation and laying of the units with this type of laying equipment. With bonded paving setts it is only possible to lay down a certain width of paving so that the vehicle after the setting down of one layer must bring another one separately to the site of the laying operation. The amount of travel involved in this procedure is very considerable. The operational zone is confined to surfaces whose dimensions are confined at least to the turning radius of the vehicle. The utilization of the equipment for the laying of setts on narrower surfaces such as foot- and bicycle-paths and the like is not possible. It is also not possible here to work from below, that is to say if the vehicle were to be standing on the road surface, because the short reach of the cantilever arm would not allow for the laying of several layers of setts in front of one another against the curbing. With the progress of the laying operations over larger surface areas, the distance which has to be traversed by the equipment becomes increasingly greater because of the increase in the distance between the storage location of the constructional elements away from the paved surface and the actual site of laying of the paving setts.

The known equipment is furnished with a grab with which the structural units, for example paving setts, may be picked up and held by the clamping action of the jaws during the lifting operation. The structural elements are thus forced up against one another and this prevents their slipping out and being dropped. There must be an uninterrupted surface for the application of the clamping jaws, because otherwise the clamping effect would not be transmitted to the blocks within the load and they would therefore slip out and fall. The layer of blocks would thus fall out from the clamping jaws of the grab. In order to be able to lay a paving as ordered by the customer, such as, for example, a "herring-bone pattern", it is necessary that half setts should be missing from the individual courses of setts which, after the laying down of the opposite-direction second course with exactly matching and opposite empty spaces half the size of a sett, would have to be filled in by the laying of complete paving setts employing manual operations. In this way the continuation of the original bonding is ensured. This is not possible with the known laying equipment because of the already mentioned indispensable continuous surface for the application of the clamping jaws. In this case the empty spaces for the paving setts to be filled in at a later stage had already been filled up during the laying of the paving setts by the insertion of half setts. If now the courses of setts are butted up against one another, then this gives rise to a continuous longitudinal joint. The advantageous bonding effect of the pavement surface for coping with braking- and starting-forces of motor vehicle is not achieved. The orders of the customer and the DIN specifications are thus not fulfilled.

In addition to this it is not possible with this grab to work with flat plate-shaped laying element, because they would be deflected from their position in either an upwards or downwards direction at the start of the clamping action because of their flat shape and the small surfaces on their edges. Even clinker bricks, namely kiln-fired products, cannot be laid without damage because of their brittleness. The edges of the blocks split off when the grab jaws are applied. In order to produce the necessary clamping force, claw-like members ar employed which are a hindrance when attempting to set down the paving unit in the correct position. For example, they hinder the setting together on the flat of the components which are to be laid. Therefore these elements cannot be lowered down onto the sand base so that the claws can be released, but, in order to prevent the claw-like gripping members from becoming caught in between the already laid elements and those about to be laid, it is necessary to allow these latter to fall out from the grab at a short distance above the ground so that they pass through the last stage of their journey under free fall. The disadvantage of this is that the units being laid do not butt up against one another properly and, particularly in the case of smaller units such as paving setts, this is readily noticeable to the detriment of the desired effect. The pattern of joints which becomes distorted in this way must, in order not to deviate from the rectilinear matrix, be corrected by an assistant worker after the laying of each unit of paving. Furthermore, very considerably frictional forces are developed between the structural elements and the gripping device which, in part, are unduly highly different on the individual sides and lead to irregularities in the setting down of the unit.

In order to avoid the afore-mentioned difficulties in the laying of complete courses of paving, it is therefore necessary to be able to pick up the searate blocks only by their upper surface, which is possible with the use of a suction lifter. Thus, for example, it is known from the French Patent No. 1,461,504 that it is possible to lay bonded paving setts with the aid of a suction lifter which is attached to the cantilever arm of a self-propelled machine. However, since it is not possible with the suction lifters which have been known for some considerable time, to keep the correct alignment of pavements fitted together from individual paving setts, provision is made according to the French Patent for the individual paving setts to be joined together with the help of separable connecting materials so that transportable plates are produced which can be laid down as such without alteration. Already at the start of the manufacturing procedure, a considerable number of setts are joined together to form a block which is intended to facilitate and accelerate the laying. After the paving setts have been laid it is assumed that the connecting material will gradually disappear, for example by dissolving away. The employment of these bonding compounds signifies very considerable additional costs for the materials and labour involved. Furthermore, there is the danger that the undesired sticking of an individual sett can entail the loosening up of the overall bonding, so that under certain conditions the lifting with the suction device becomes impossible. Already for this reason the utilization of the known type of suction lifter has not been able to prevail in actual practice.

The lifting and laying of paving setts, in particular of a plurality of them in a desired arrangement of the bonding pattern, brings very many problems with it which, up till the present time, have not been solved in the desired manner.

Concrete paving setts have a high specific weight which makes it necessary to produce a high degree of vacuum and also a large surface area for the bearing contact. The laying of a complete layout of paving setts during one working shift requires an exact alignment and complete contact of the paving setts with one another.

The individual suction cups of a lifter must be able to be turned in all directions, that is to say, not only about a vertical axis but also about a horizontal axis because, very frequently, the individual setts due to rough packing and handling during delivery will be lying at various angles in the stack of pallets. In addition to this the individual setts in a layer of paving setts are not always seated compactly and evenly in one plane, so the compensation for the height must be possible for each of the individual suction cups.

The suction lifter must either possess double the number of suction cups as the number of setts to be lifted so that it may be used for laying of special bonded patterns (e.g., herring-bone), or else the shape of the suction cups must be adapted to the manufactured shape of the paving setts which are to be laid. In this case the suction cup can have the format of the setts (ca. 10/20 cm) [with appropriate safety zone distance to the adjacent joint between the individual setts], which has the advantage that the suction bearing surface is larger in area than the arrangement with two separate suction cups per sett, and therefore it is not necessary to have such a high degree of vacuum as with the double arrangement of suction cups to each paving sett. Because of the high specific weight of the setts this suction application surface should be as large as possible because otherwise the attachment area would not be great enough for the lifting force or else the vacuum would be insufficient.

With particularly rough and porous surface on the paving setts it is advantageous to decide upon the larger bearing surface area because, even with correspondingly large vacuum equipment, more atmospheric air is able to enter underneath the sealing means.

Types of equipment are known in which a plurality of suction cups are suspended from a carrier-plate or -rail so that, with adequate vacuum equipment and the requisite associtated suction bearing surface, it is possible to transport liftable products when the carrier-plate can be lifted up and swung around into position with the assistance of a crane, an excavator cantilever arm or a suitable framework.

The suction cups which can be moved axially or with angular displacement and must be additionally supported on the carrier-plate are, in the case of the known systems, the most expensive, heaviest and technically most-complicated pieces of the equipment.

The plurality of the hose connections for the individual suction cups are connected to a vacuum pipeline which leads to a vacuum pump. The expensive construction and suspension of the indivudual suction cups is necessary because a narrowing down of the cross-sectional area from the suction bearing surface directly upon the product to be lifted up to the vertical suction pipe had to be adopted. This narrowing down of the suction bearing surface (cross-sectional constriction) leads to the situation where the suction cups must also be suspended from the carrier-plate by using bearing cams.

The problem to be solved by the invention is to develop a suction lifter of the type initially referred to in such a manner that the plurality of complicated individual component parts may be dispensed with and the overall construction will become simpler and of reduced weight. The solution of this problem in accordance with the invention is distinguished by the fact that the suction lifter is rectangular, possessing suction cups fabricated in the form of bellows which are able to be moved axially and angularly independently of one another and which has pivotably articulated directional jaws on all sides for pressing against the products being lifted, in which case there is an interrupter (cut-off) valve provided between the vacuum pump and the vacuum carrier collector for cutting-off the suction to all the suction cups when the products being lifted are to be set down.

If the suction carrier cross-section, which is determined by the type and weight of the products to be lifted and by the degree of vacuum available, is allowed to continue on up past the carrier-plate without any diminution of the cross-sectional area to form the vacuum collector space above the carrier-plate for all the suction cups, then it is possible to dispense with the totality of individual suction cups of the conventional type as well as dispensing with all of the connecting hoses to the collectors, and in addition there is a considerable reduction in weight.

This saving of weight is of great significance if, during the laying of constructional elements, it is necessary to travel over the foundation material which has still not been compacted into its final state of mechanical stability.

Moreover, the decisive advantage is the saving in weight, because with carrier vehicles having a cantilever arm the whole of the vacuum lifter is always suspended at the outermost end of the cantilever arm which is the most unfavorable loading-stress condition for the cantilever arm.

The saving in weight on the suction lifter is a direct bonus for the useful payload of the equipment which makes it essentially more economical to operate.

The function of the suction cups is taken over, according to this present invention, by a bellows. The vacuum pipeline and the carrier-plate of conventional type are replaced by a new unit. It is a flatly-constructed container (in order to reduce the delays in each working sequence arising from the pendulum action) to the underside of which there are attached supports to receive the bellows. On the upper side of the container provision is made for the suspension of the rotary servo-mechanism and for the pivotably articulated directional jaws.

With the suction lifter configured according to the invention it is possible to lift components with high specific weights, for example concrete blocks and the like, and to lay them. Along with this it is possible to pick up a plurality of components which have already been arranged in a predetermined laying pattern and to lay them without mutual displacement so that the laying pattern is maintained. This requires a sufficiently great carrying capacity which, however, can only be guaranteed if the vacuum under the individual suction cups is sufficiently high. It has been shown, however, that the material from which the concrete blocks is fabricated does not always have the necessary degree of compaction, so that the blocks have a porous micro-structure allowing the air to pass through in considerable amounts. If the concrete components have particularly poor bonding propeties this leads to porous micro-structures and this prevents the building up of a sufficiently high degree of vacuum. The manufacturers of concrete products, however, are not always in the position to overcome such defects because the bonding of the concrete components depends to a very considerable extent upon the humidity of the environmental air.

However, it is not only concrete blocks that are laid in a bonded pattern which, in addition must be suitable to withstand foot traffic or travel of vehicles over it, but very frequently a ground reinforcement is required by the laying of clinker bricks in a bonded fashion. The picking-up of clinker bricks has, however, not been found to be possible up till the present, because kiln-fired clinker bricks have a porous micro-structure and thus a brittle kiln-fired material is being dealt with. For this reason it has previously only been possible to lay clinker bricks manually. The employment of lifting devices with gripping tongs led to considerable damage to the edges of the bricks. Very surprisingly, it has now been found that the density of the kiln-fired clinker material is sufficient to allow the maintenance of a sufficient degree of vacuum for picking up the bricks. There is not enough air sucked through the brick material during the lifting procedure for any significant diminution of the vacuum on the suction side. Other incidental influx of air is not possible because of the special construction of the suction lifter being employed which has independently adjustable suction cups in both axial and angular directions. Under these conditions it is equally possible to pick up and lay clinker bricks in the same manner as has been possible for a long time now with the larger concrete blocks using conventional suction lifters.

It has been found to be particularly favorable to have an arrangement of connection openings between the suction chamber and the suction cups in the nature of air-passage openings, keeping their diameter considerably smaller than that of the connection nozzles for the suction cups. Insofar as the air-passage openings are brought up so close to the surface of the material being lifted that they come into the immediate vicinity of the region of increased flow velocity of the air passing through, this means that the carrying capacity for porous constructional materials is further increased.

Examples of embodiments of the invention are depicted diagrammatically in the drawings and dealt with in detail in the following discussion.

Figure 2:
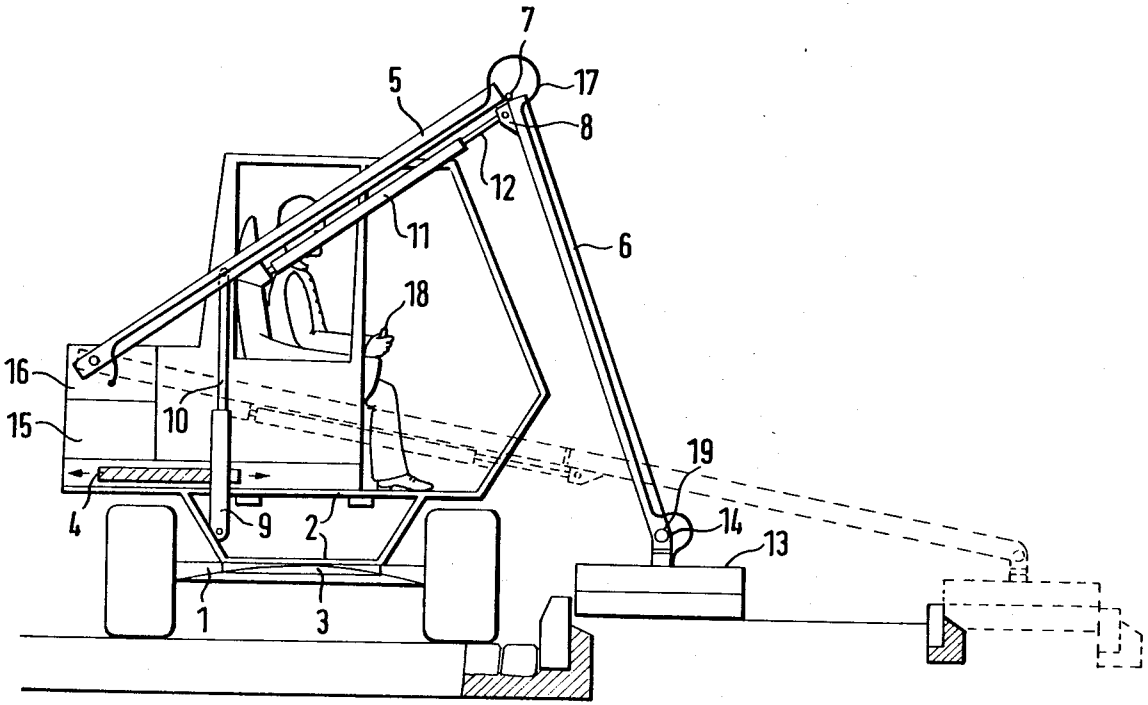
Figure 3:
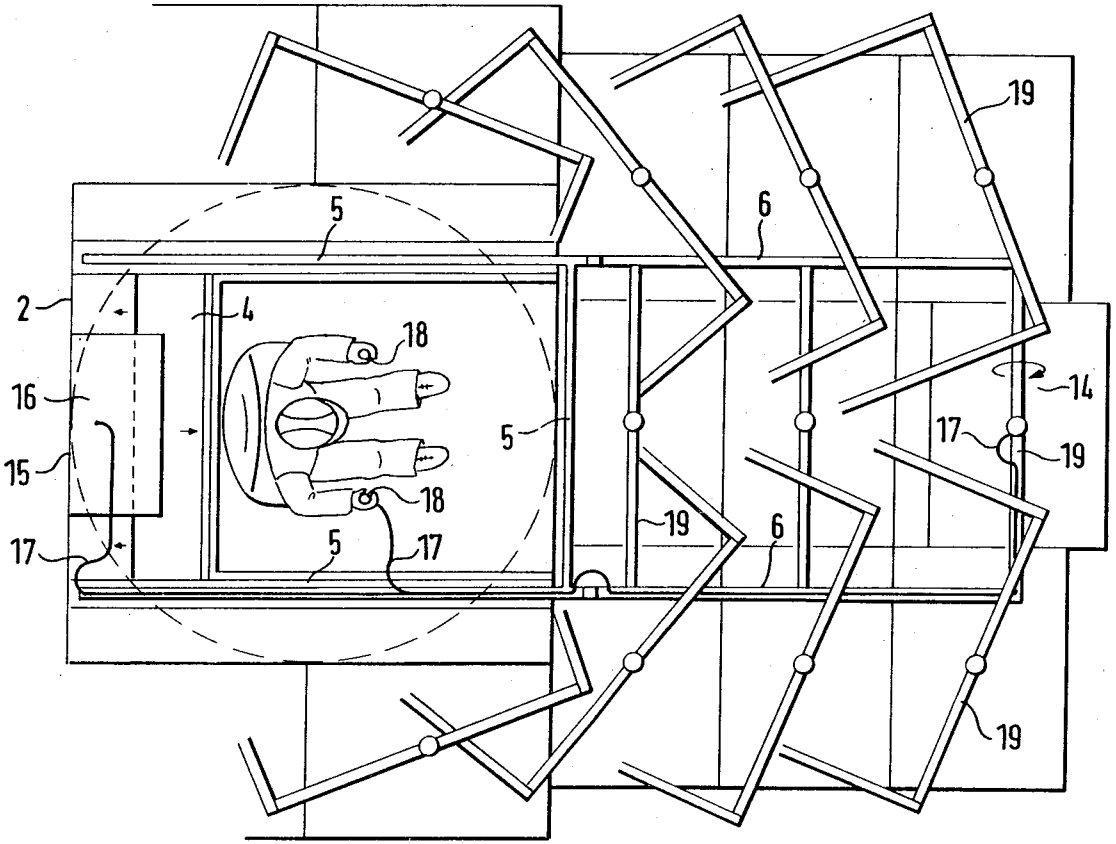
Figure 4:
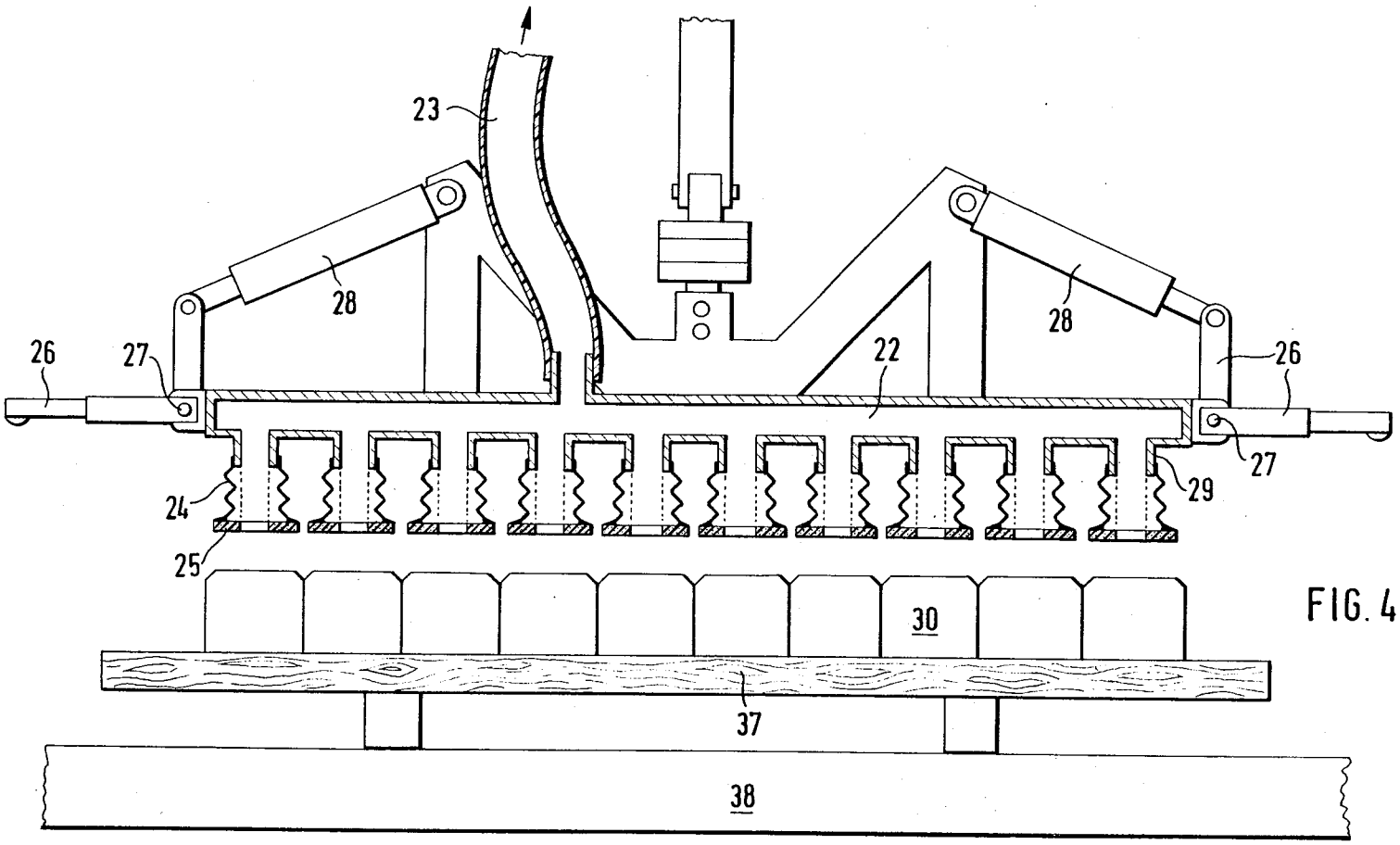
Figure 5:
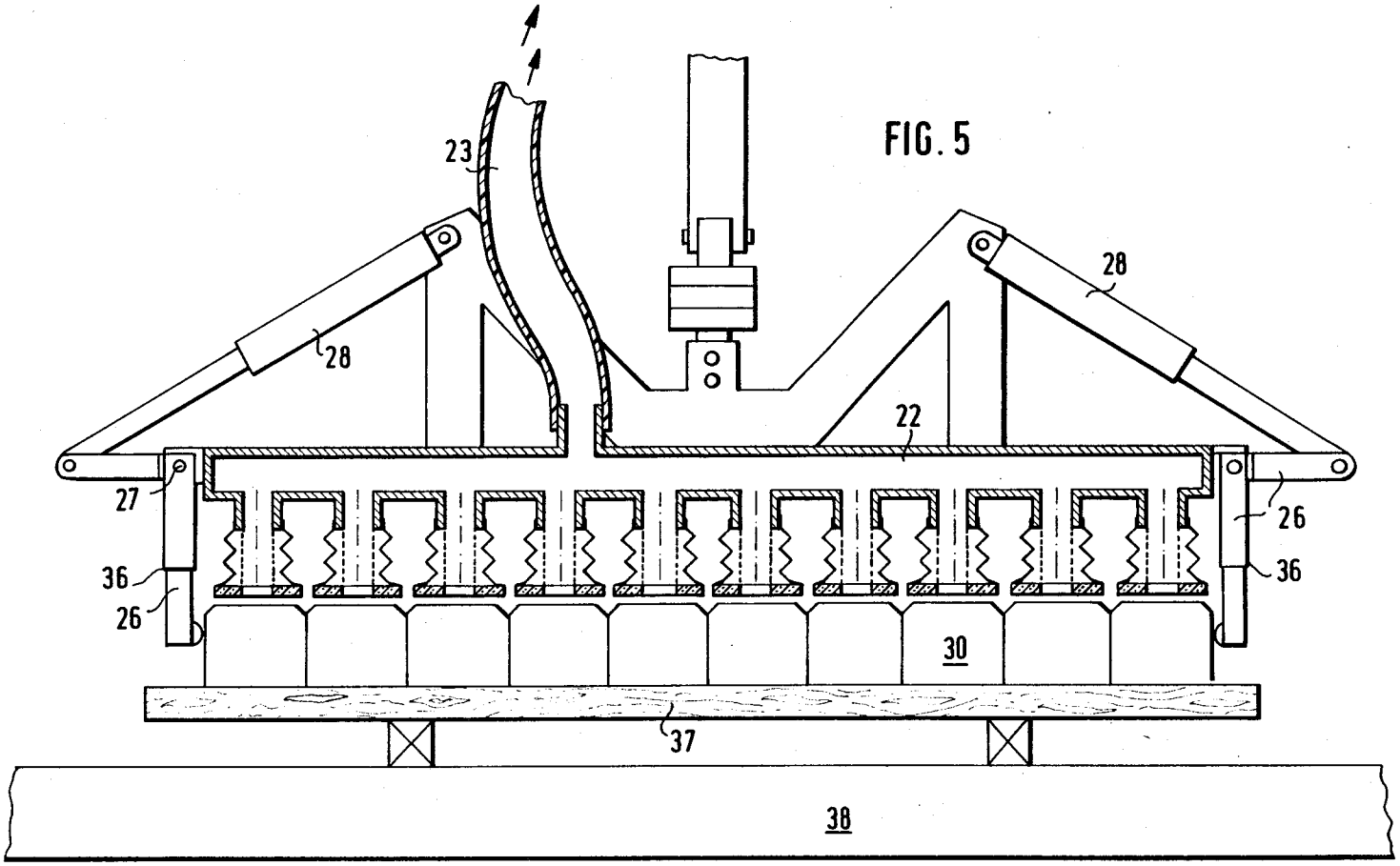
Figure 6:
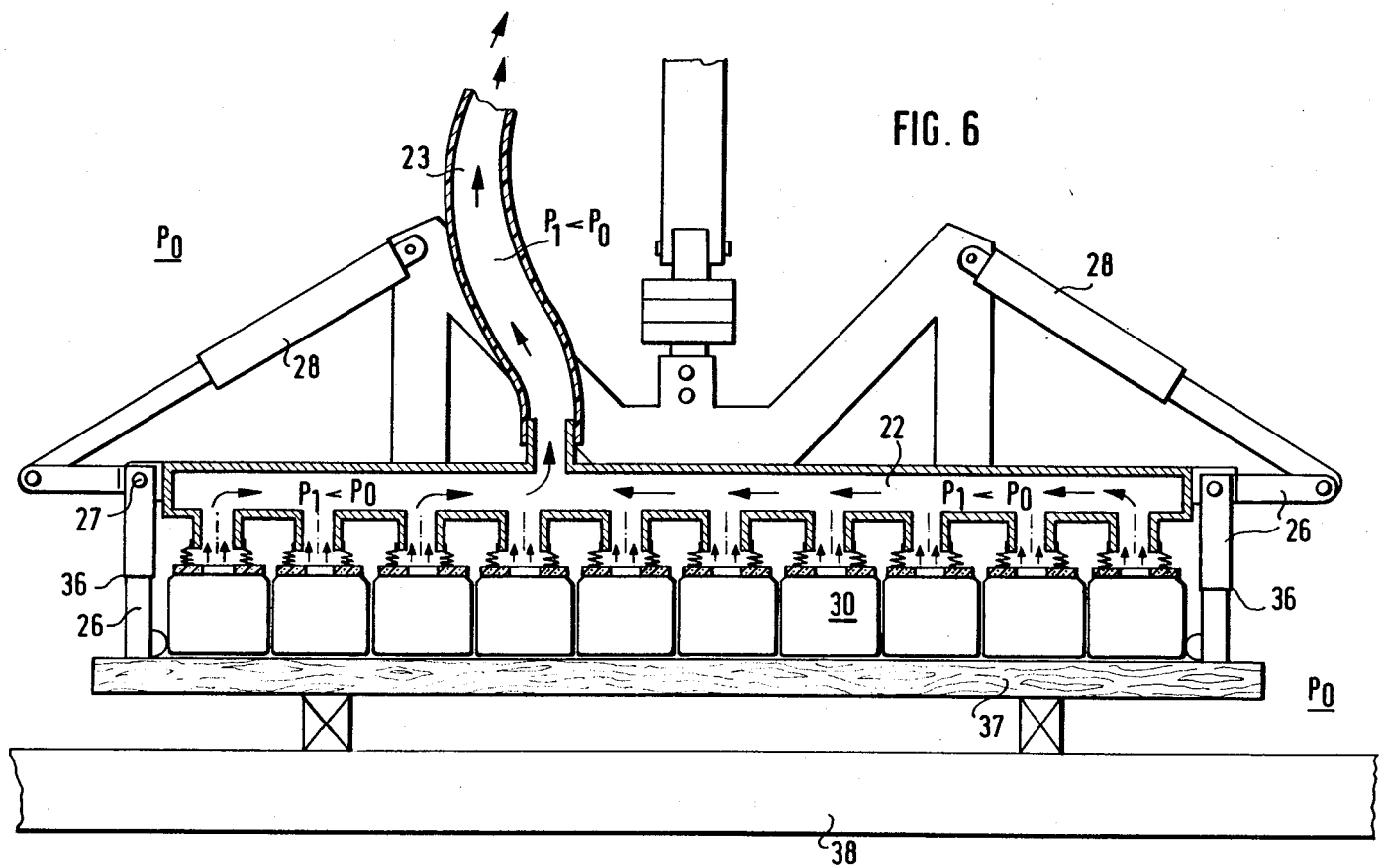
Figure 7:
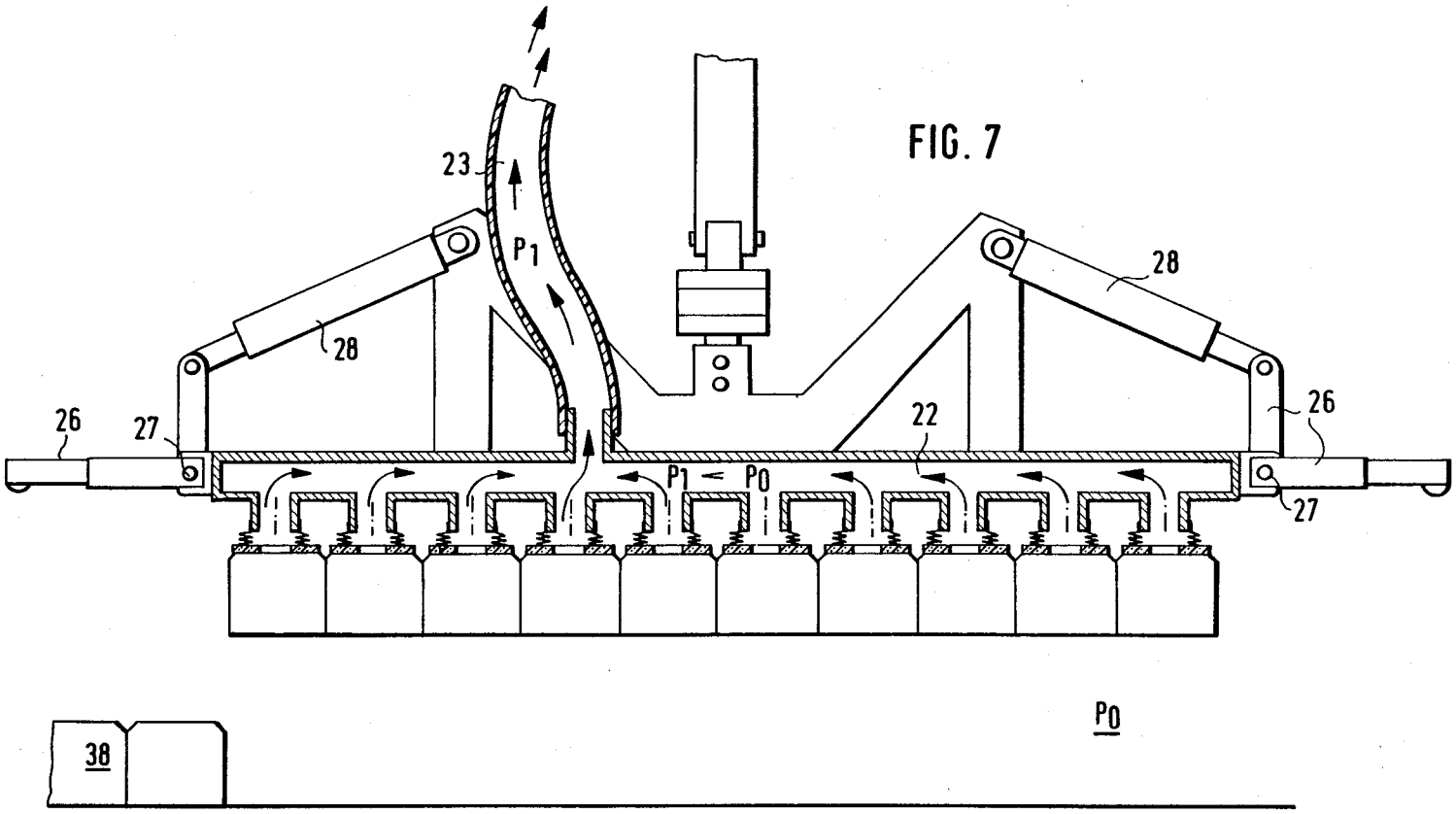
Figure 8:
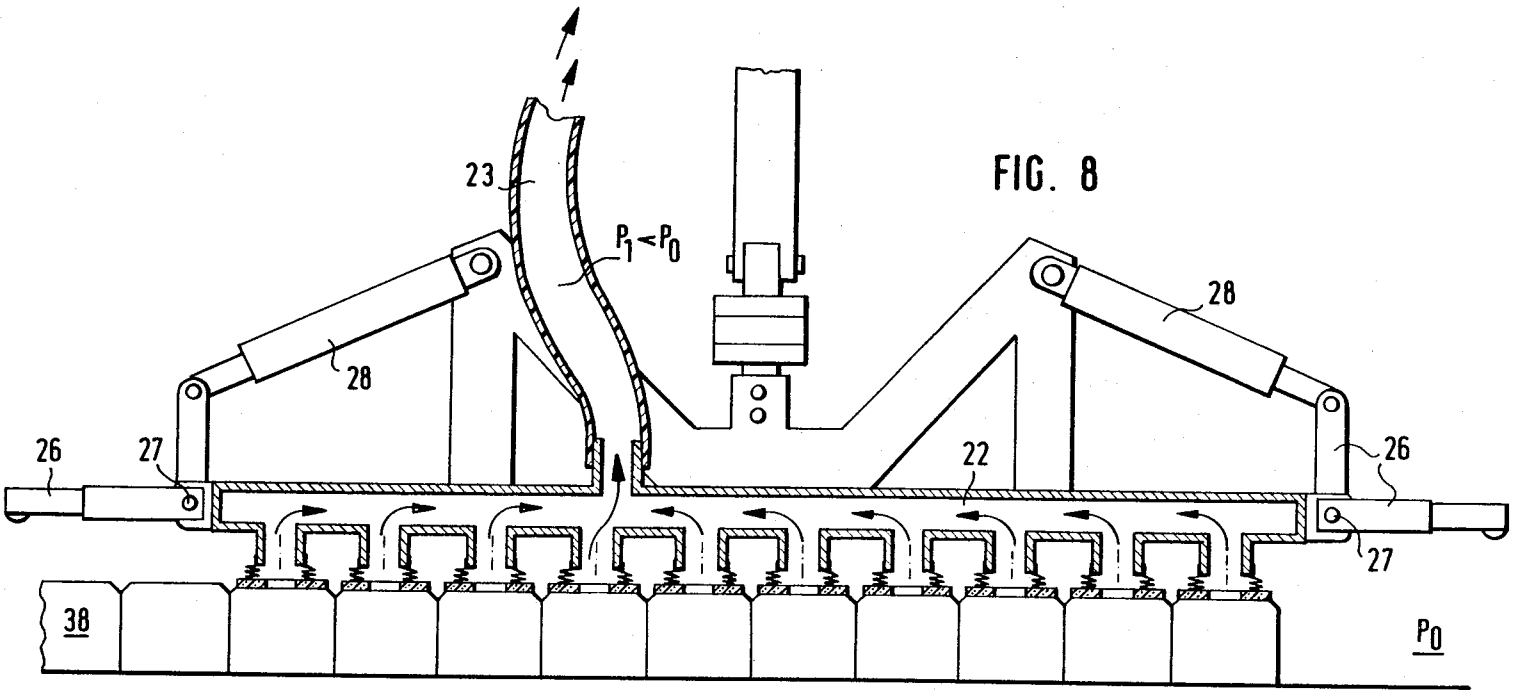
Figure 9:
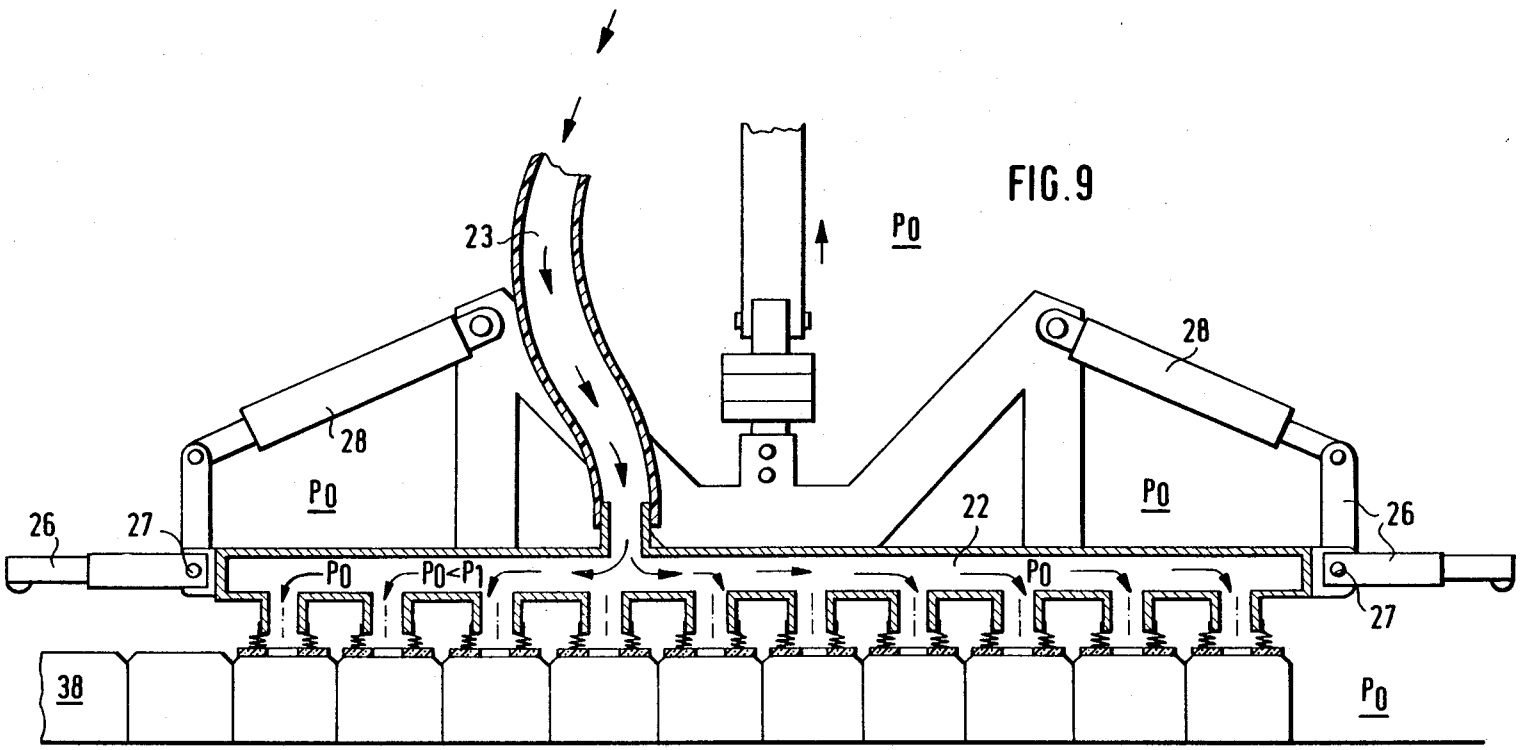
Figure 10:
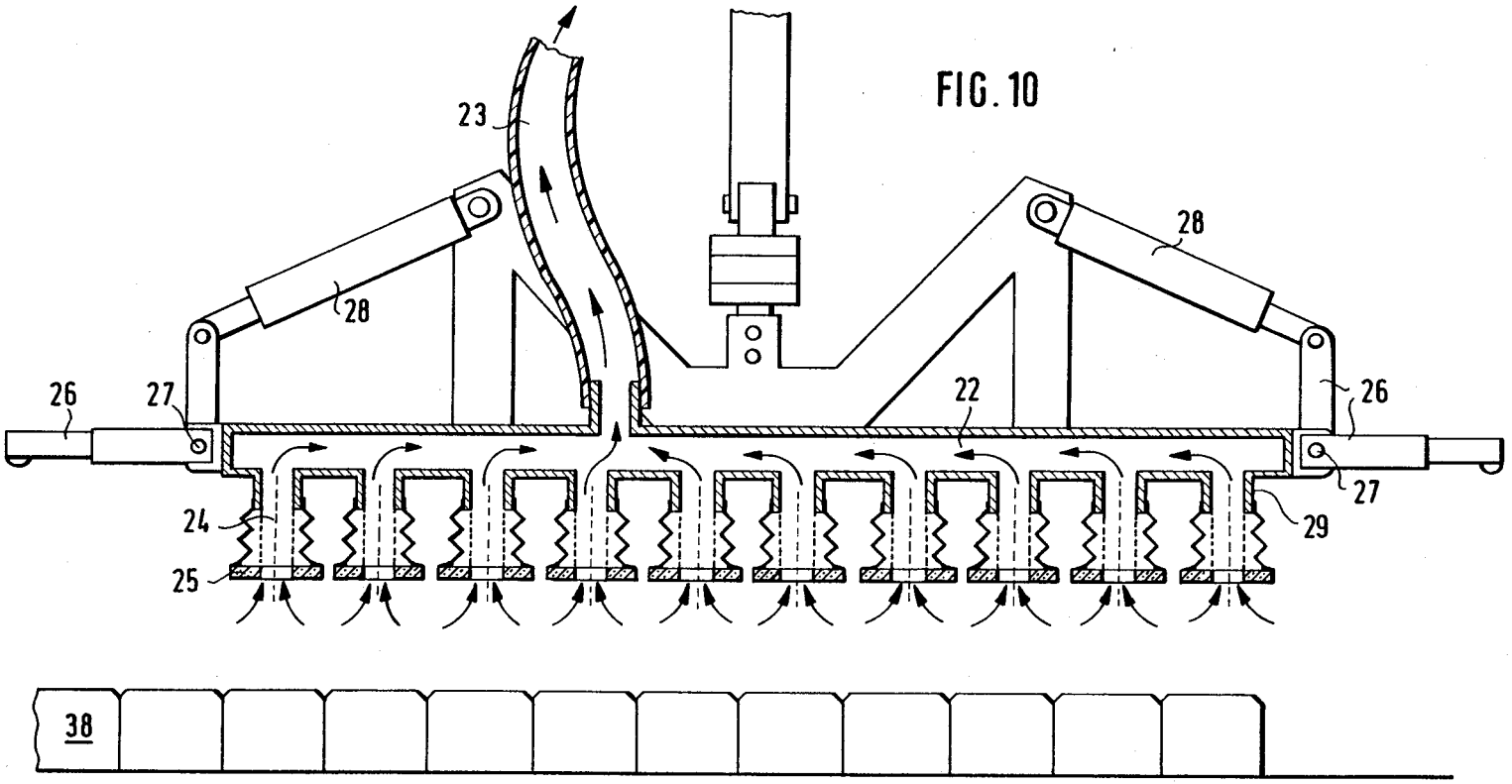
Figure 11:
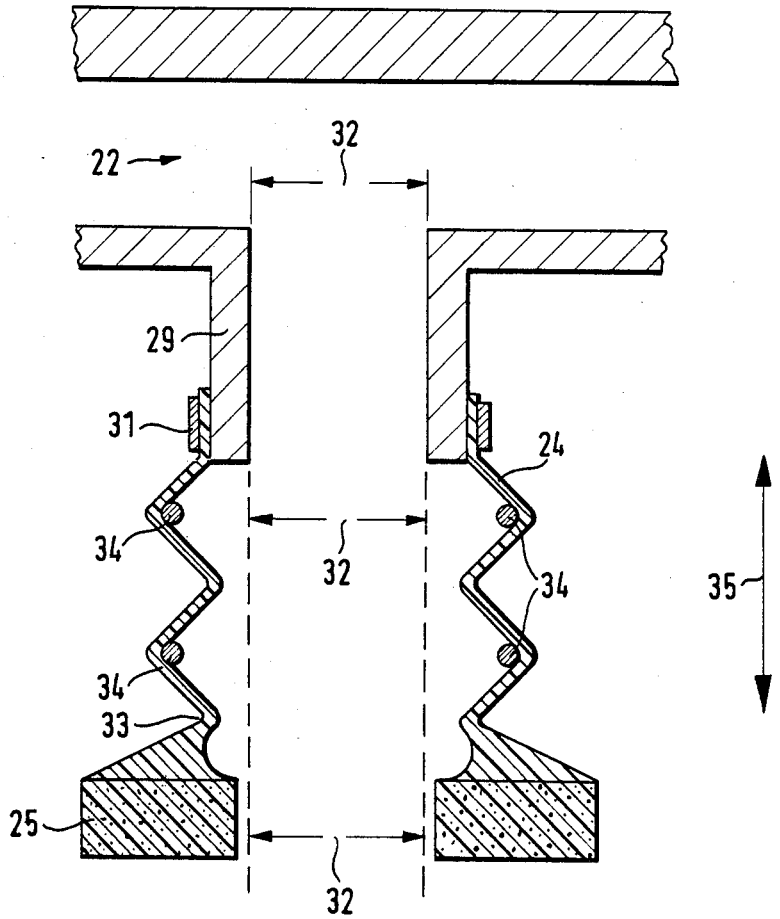
Figure 12:
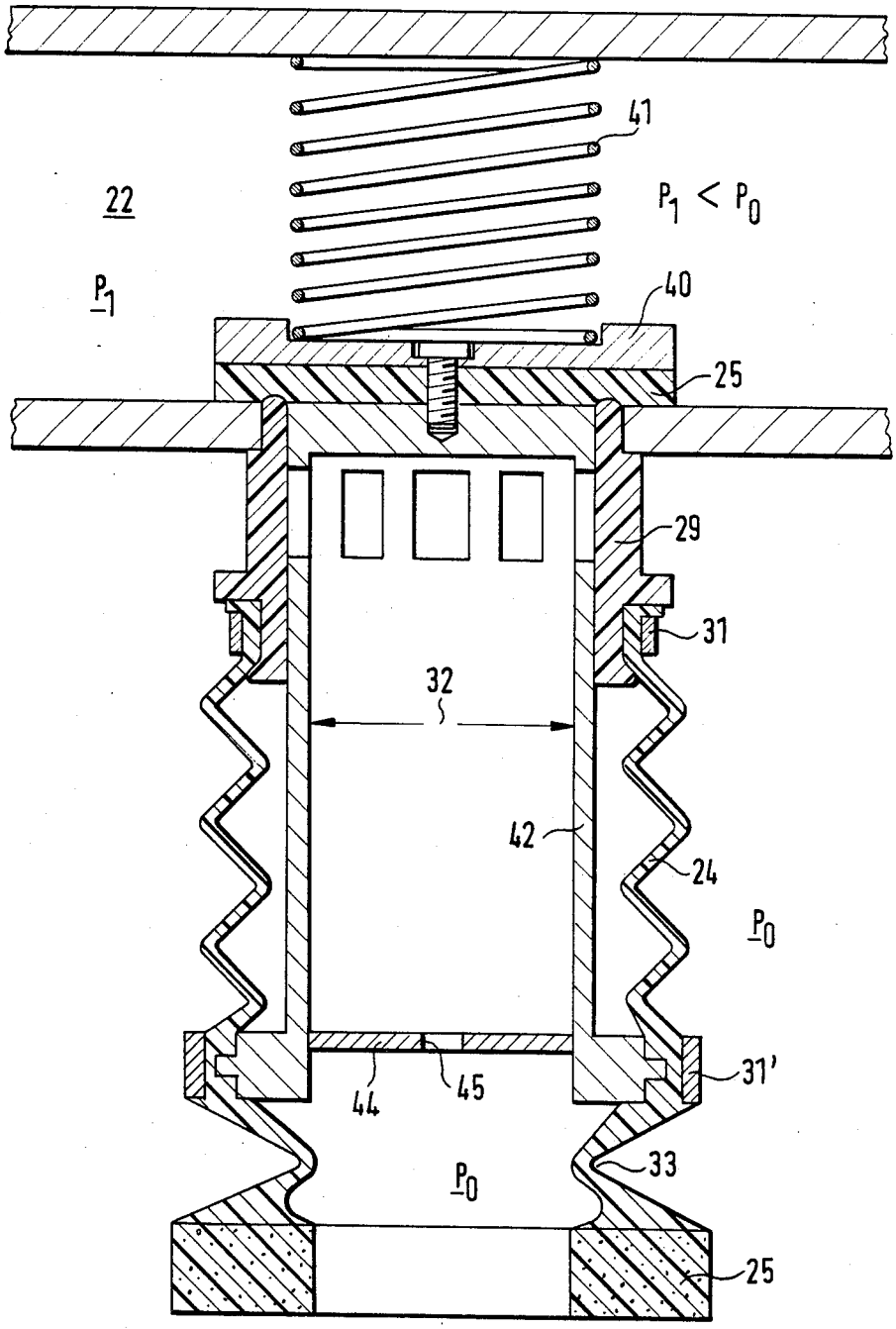
Figure 13:
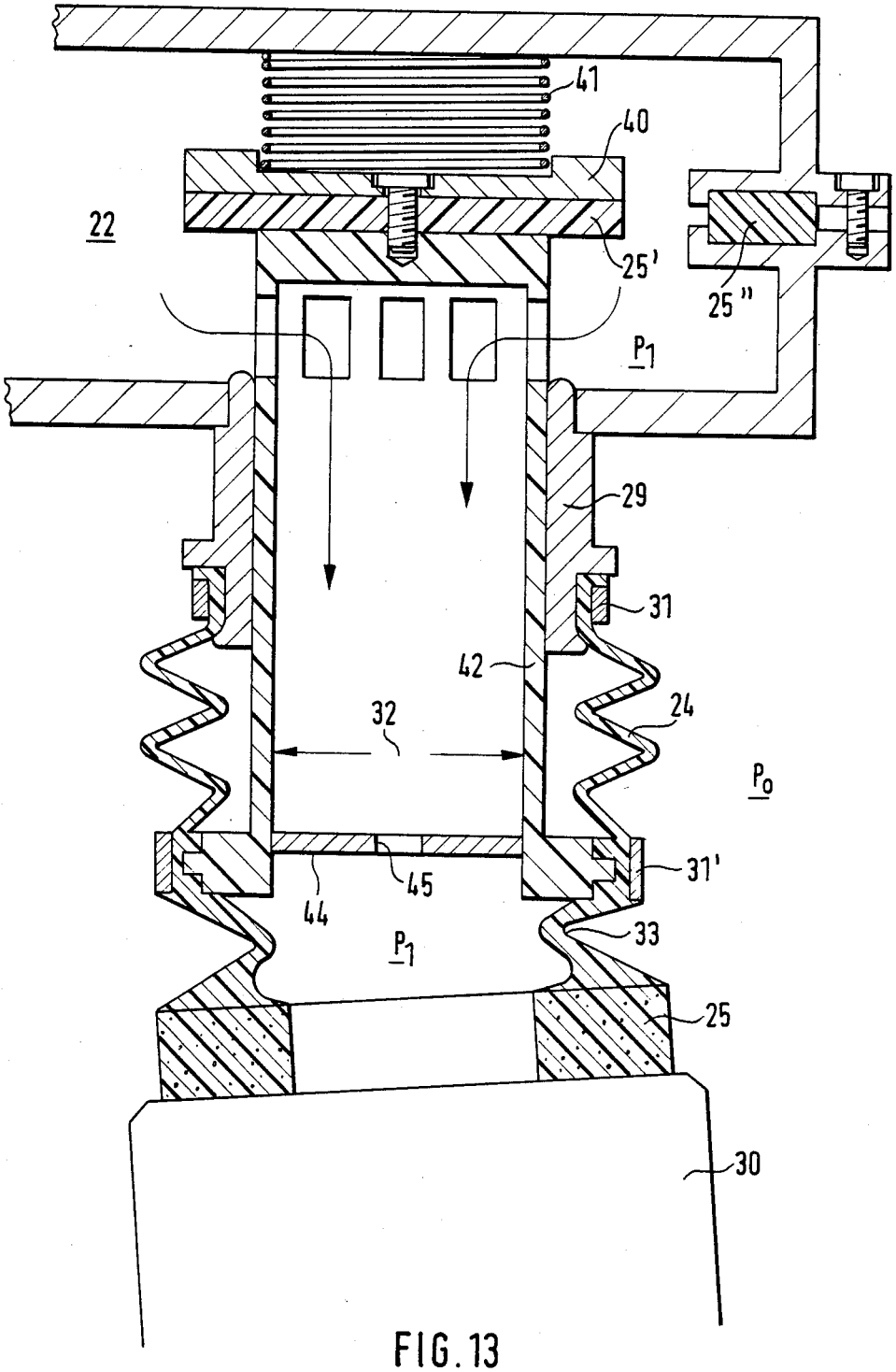
Figure 14:
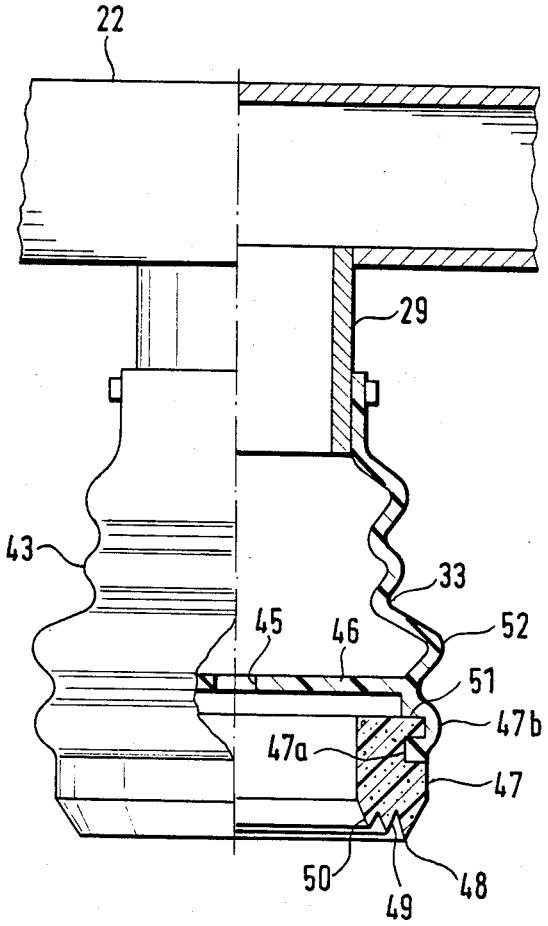
Figure 15:
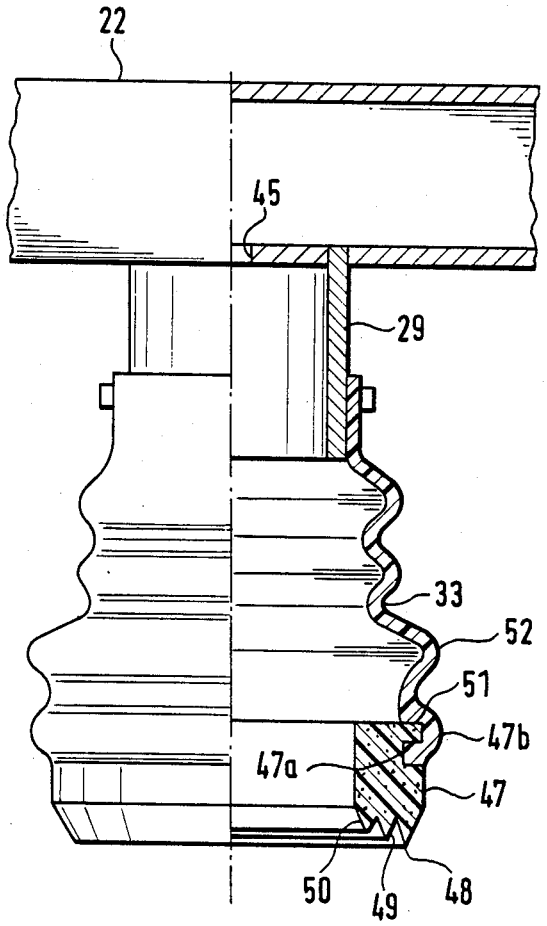
Figure 16:
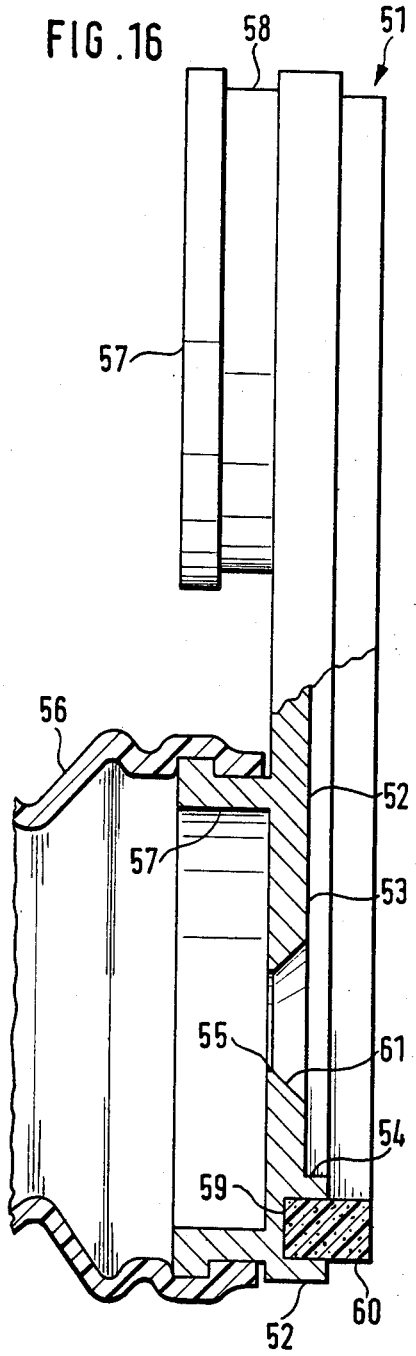
Figure 17:
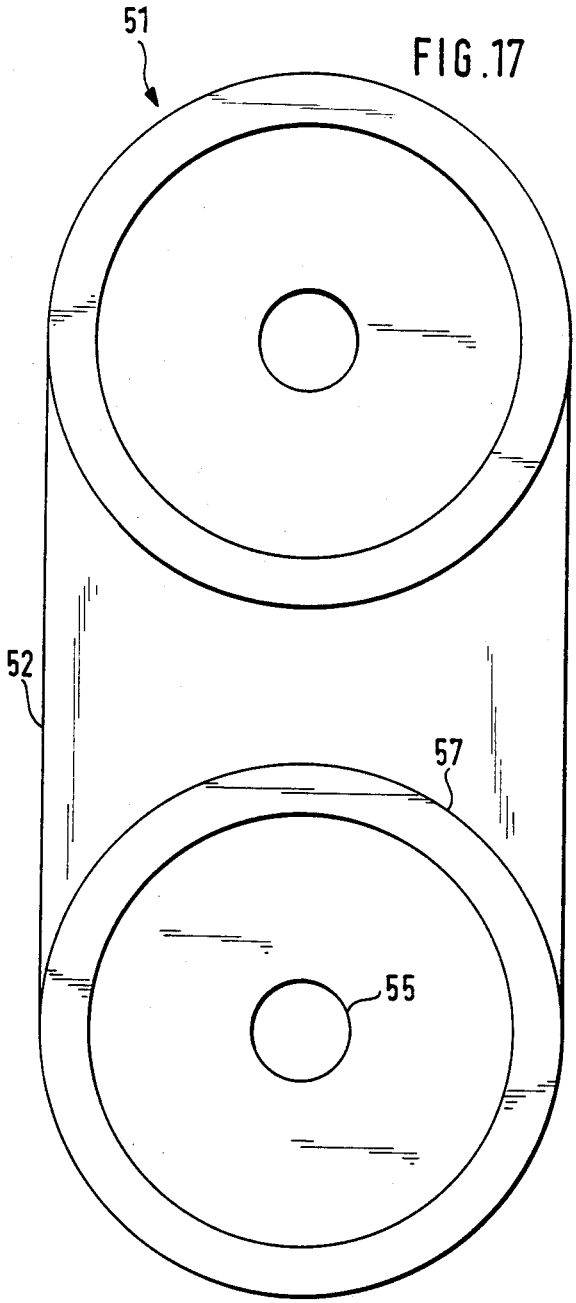

There is shown in:

FIG. 1 the side elevation of laying equipment in relation to the direction of travel, FIG. 2 the laying equipment seen from the front during work in the lateral direction, FIG. 3 a plan view of the laying equipment according to FIG. 1, FIG. 4 the front end of the suction lifter in the opened position, FIG. 5 the front end of the suction lifter after closing the directional jaws, FIG. 6 the front end of the suction lifter after positioning and applying the suction cups, FIG. 7 the front end of the suction lifter with opened-up directional jaws and the paving setts which are lying horizontally as positioned by the atmospheric pressure after slewing of the cantilever arm into the laying position, FIG. 8 the front end of the suction lifter after the laying procedure, FIG. 9 the front end of the suction lifter during admission of air into the vacuum chamber (The valve between the vacuum pump and the suction lifter is actuated electro-magnetically by the person operating the equipment), FIG. 10 the front end of the suction lifter after completion of the laying operation, FIG. 11 a suction cup on the form of bellows, on an enlarged scale, FIG. 12 a suction cup with an axially-displaceable cylinder and a bellows surrounding said cylinder, as well as with a throttle plate in the cylinder, FIG. 13 the suction cup according to FIG. 12 in the working position, FIG. 14 a suction cup configured as bellows with a multi-lipped sealing rim and a throttle located within the bellows, FIG. 15 a suction cup in accordance with FIG. 14, however with the throttle located within the connection socket, FIG. 16 a side view of a suction, shoe partly in section and FIG. 17 a plan view of the suction shoe in accordance with FIG. 16.

More specifically, there are denoted by:

1 chassis
2 carriage
3 turntable
4 shiftable counterweight
5 boom framework
6 cantilever arm
7 fulcrum for the cantilever arm
8 lever plate of the cantilever arm
9 hydraulic cylinder for shifting of the framework
10 piston rod of the hydraulic cylinder
11 hydraulic cylinder of the cantilever arm
12 piston rod
13 a gripper constituting a suction lifter
14 center of gravity of the suction lifter
15 driving motor
16 vacuum pump 17 suction conduit
18 actuating lever
19 transverse brace defining an axis of rotation
22 suction gatherer or support with a manifold
23 vacuum hoses
24 suction cups constituting bellows
25 seal of elastomeric material
26 directional jaws
27 axes of rotation of the directional jaws
28 adjusting cylinder for the direction jaws 26
29 nozzle for the bellows
30 paving stones
31 hose clamp
32 minimum internal suction cross-sectional area
33 preprogrammed zone for the first-developing angular movability
34 stabilizing rings
35 axial movability of the bellows
36 axial movability of the directional jaws
37 pallet board
38 already laid pavement
40 metallic disc and spring receiver
41 cylinder restoring spring
42 axially shiftable cylinder
43 bellows with throttling opening
44 throttling plate
45 throttling opening
46 throttling plate in the bellows
47 sealing ring
47*a* fastening groove for the bellows
47*b* fastening flange for the sealing ring
48 outer sealing lip
49 median sealing lip
50 inner sealing lip
51 suction shoe
52 suction plate
53 recess in the suction plate
54 heel
55 through hole or orifice for air
56 suction bellows
57 connecting nipple
58 peripheral groove
59 groove for reception of the sealing lip
60 sealing lip
61 chamfer in the through hole For the laying of constructional elements, such as for example bonded paving setts, to produce a roadway surface capable of bearing loads, the suction lifter 13 with its suction cups 24 and with its directional jaws 26 swung up out of the way is lowered down onto the paving setts. By actuating the adjusting cylinder 28 the directional jaws 26 are swung down into position by which means the individual setts of the complete layer are positioned at right angles and/or parallel to one another. This positioning has two decisive advantages. After any unavoidable displacement of a minor nature from the bonding pattern of the paving elements during transport from the concrete factory to the laying site, the units are restored to their original position so that they will, as planned for in advance, lie in the proper grid pattern under the suction cups. They are positioned exactly at right angles and/or parallel to one another before they are lifted up by the application of the vacuum which ensures a uniform rectangular pattern of the jointing right up to the completion of the laying on the sand foundation. Any further subsequent correction of the jointing pattern can be entirely dispensed with. By placing the suction lifter in position and subjecting the suction cups to reduced pressure by way of the collective suction carrier after the directional jaws have been closed, the bellows (suction cups) are forced down against the setts.

The sealing means made of elastomeric material 25 is pressed down onto the paving sett because of the outside pressure of the air. The preprogrammed angular flexibility 33, FIG. 11, in the lowest region of the suction cup guarantees a complete sealing even against the surface of the unit which may have become slightly tilted within the whole assembled packet. Subsequently, the axial height compensation 35 of the bellows 24 is brought into play if the setts are lying at different heights, a situation which cannot be avoided during the rough handling in transport.

Immediately after sealing the vacuum is increased because the vacuum pump is operating continuously. The suction carrier-plate is lifted up and it is swung around into the laying position by the slewing of the cantilever arm of the carrier vehicle. The suction cups remain in the compressed position because the inner cross-section of the suction carrier 32 continues on unchanged right up to the suction carrier-plate 22. The setts arrange themselves horizontally because of the compensatory effect of the atmospheric air pressure (FIG. 7). Before setting down the paving setts, the directional jaws 26 are swung up out of the clamping position shown in FIG. 6 to the starting position as seen in FIG. 4.

This swinging up of the directional jaws provides a further decisive advantage. The operating person's view of the paving setts suspended from the suction cups 24 becomes completely unobstructed. The layer of setts can then be carefully aligned and with the aid of the swivelling trunnion of the grab which is rotatable about the vertical axis, the load can be positioned in the correct arrangement and lowered down onto the surface as desired, which is actually the prepared sand foundation.

FIGS. 1 and 2 give a general picture of the lifting of the framework and the cantilever arm 6 with its articulated pivoting action, without the need for moving the carrier vehicle from its position. It may be recognized from FIG. 3 how it is possible to place the individual layers of paving setts alongside one another by a combination of slewing and raising and lowering of the cantilever arm and actuation of the swivelling trunnion. This is accomplished by the cardan joint universal suspension of the whole suction lifter in combination with the capability of rotating it around a vertical axis in combination with the raising and lowering of the support frame and the cantilever arm. The cantilever arm in combination with the suction lifter 13 is pivotably attached at the fulcrum 7 to the boom framework 5, and a lever plate 8 in association with a hydraulic cylinder serves the purpose of raising and lowering the arm. Because of the adjustable position of the counterweight 4 it is possible to compensate for the differing bearing-capacity moments of the loads of materials of differing specific weights, depending upon the distance of the suction lifter from the centre of gravity of the transport vehicle. For transporting of the constructional components which are to be laid from the storage location to the working site it is only necessary to have one operating person, even though the work performance and utilization compared with the previously known pavement-laying equipment are considerably improved and because of simplification the operations can be carried out much more economically.

The method of operation of the automatic opening is similar to the concept originally mentioned of the use of bellows for the suction cups. However, in this case the carrier collector is kept continually under vacuum, so that the lost time during each operating cycle due to the pendulum effect only consists of the sum derived from all the chambers of the individual suction bellows. In the lowest first pleated region the bellows has the same function, namely that of compensating for the tilting of the individual units, as in the first description. Above the lower hose-clip band and the serration with the synthetic-material tube the bellows has, however, a purely protective function against contamination. The sealing-means 25 made of elastomeric material (sponge rubber) which is applied flatly on top of the cylinder cover is held in place by a turned member 40 which acts as a seating for the restoring spring 41.

Method of operation:

The collective carrier 22 with its individual suction bellows is forced down onto the layer of paving setts (and the material to be lifted) by means of the cantilever arm of the carrier vehicle. The angular flexibility 33 of the lowest fold of the bellows comes into play, after which the height compensation is effected, because the synthetic material tube with its upper cover is forced upwards against the compression of the restoring spring. In this way, depending upon the pressure applied, which in its turn is dependent upon the effectiveness of the sealing-means 25 against the product being lifted, the reduced pressure to the cavity within the cylinder 42 is released. The cylinder has the calculated suction cross-sectional area 32 right throughout its length appropriate for the product to be lifted. When the lifted product is to be set down again following its successful transport, air is admitted to the collective carrier, thus creating the necessary pressure equilibrium. The restoring spring 41 closes the collective carrier chamber 22 once again with the aid of the sealing-means 25 against the interior of the cylinder.

The operational cycle then commences again from the beginning.

In order to ensure that the reduced pressure of the suction lifter is not destroyed if one of the paving setts should become detached from the suction bellows immediately after lifting a layer of setts, for example because of damage to its surface, a throttle point is provided which, by way of example, can be located within the cylinder 42 enclosed within the bellows 24 or else it may be located directly within the bellows 43 itself.

When the throttle point is situated within an axially displaceable cylinder 42 (FIGS. 12 and 13) it is important to ensure that the throttle orifice 45 of the throttle point is at a distance from the lower end of the cylinder 42. For example, the throttle orifice 45 can be located in a base plate 44 at a small distance from the bottom rim of the cylinder.

In the example of embodiment depicted in FIG. 14, the throttle orifice 45 is located in a partition wall 46 made of the same material as the bellows itself.

As soon as an operationally-ready suction cup in accordance with FIG. 12 or 14 is applied to the object to be lifted which has an adequate suction surface area, the suction force $P_1$ builds up below the throttle point 45 until it is sufficiently less than the pressure $P_o$ of the surroundings. If the object to be lifted, designated as 30 in FIG. 13, cannot be raised up, then the throttle orifice 45 ensures that the reduced pressure $P_1$ within the cylinder 42, or within the bellows 43, as the case may be, is not suddenly released so that the increased pressure can gain almost unhindered access to the vacuum pump which would diminish the effectual operation of the rest of the suction bellows very considerably.

With the location of the base plate 44 of the cylinder above the lower end of the cylinder, the necessary suction carrier cross-section, which is determined by the dimensions of the cylinder, is completely preserved. This signifies that the bellows is not subjected to stress by the weight of the product being lifted.

A similar situation occurs with the location of the throttle point in the region of the lower end of the bellows and thus in the immediate vicinity of the product being lifted (FIG. 14). It is left to the fabricator, depending upon the forces to be transmitted and the material available for the bellows, and upon the material used for producing the sealing-means for the closure of the lower end of the bellows, as to what region of the suction bellows the throttle point is to be located in.

The configuration of the sealing ring has a deciding influence upon regulated fulfilment of the function of the suction bellows. In the example depicted in FIG. 14, the sealing ring is provided with three concentric lips 48–50 arranged one inside the other. The sealing lips have different heights and a conical surface configuration. In this way a particularly reliable sealing effect is achieved. During the lifting procedure the seating of the outermost sealing lip 48 comes into effect first of all. Because of the forces developed this is only subject to compression until the second sealing lip 49 comes into contact with the surface of the product being lifted and subsequently also the sealing lip 50, if the circumstances require it, comes into contact with the surface. Tilting sideways is prevented by the shape of the sealing lips. By configuring the lower end of the bellows in combination with a bearing flange **47*b* and a circumferential groove 47*a* it is possible to detach the sealing ring 47** from the bellows without any difficulty and to replace it as see on as the severe stresses causes the effectiveness of the sealing lips to be diminished. Under these conditions the material of which the sealing ring is fabricated can be considerably softer than the material for the bellows. Because of the softness of the sealing-ring material it is possible for it to bridge over surface irregularities without disadvantage to the sealing effect.

According to the example of embodiment shown in FIG. 15, the throttle point is at the entrance of the connection nozzle 29 for the bellows. For the sake of simplicity it is sufficient to have an orifice with the throttle cross-section in the wall of the reduced-pressure collector chamber 22.

The important thing in the construction of the bellows is above all that its lower region should have a larger diameter as may be recognized at the position of the pleat 52. In this way the necessary security is achieved so that the bellows always reacts first of all to the pressure from the sealing side (mostly from below) with an angular movement followed by an axial displacement. The angular movement is thus initiated at the point 33 which is pre-programmed for this purpose and can also be recognized in the forms of embodiment depicted in FIGS. 11, 12 and 13. The full effect of this angular flexibility is only first fully achieved in the forms of embodiment shown in FIGS. 14 and 15. Here it is simultaneously ensured that the total carrier cross-section of the sealing ring 47 comes into effect and any slipping sideways is avoided by a flexing of the sealing lips. The construction of the bellows for the attainment of a particularly effectual angular movement therefore acquires particular importance.

The suction shoe 51 (FIGS. 16 and 17) consists of a plate 52 on the underside of which there is a flat recessed area 53 to form a suction chamber. The recess 53 is formed by the continuous heel 54 around the border of the plate 52. The recess 53 is connected with the suction bellows 56 by way of the apertures 55. Short connection sockets 57 which are provided with peripheral grooves 58 serve for fastening the suction bellows to the suction shoe, thus making possible a positively-locked connection to the bellows-shaped suction cup. In addition to this, on the underside of the suction shoe, there is a peripheral groove 59 for the accommodation of a sealing lip 60 fabricated from soft elastomeric material. The recessed chamber 53 in combination with the sealing lip 60 forms the complete suction chamber of the suction shoe.

A nozzle-like configuration of the apertures 55 is achieved by the chamfering 61 of the edges of the hole, so that there is an additional reduction of pressure in their vicinity with an associated increase in the carrying capacity.

From the overall representation it is easy to recognize that the intermediate space between the two suction bellows is almost completely involved in the suction effect and thus the effectual suction surface area is considerably increased without the necessity of increasing the performance of the vacuum pump.

I claim:

1. Self-propelled apparatus for manipulating liftable commodities such as arrays of concrete, clinker brick and natural stone components of paving sets, comprising a mobile arm; means for moving said arm; a suction lifter including a support carried by said arm and a polygonal assembly of suction cups which depend from said support and each of which includes a bellows elastically deformable angularly and axially independently of the bellows of each other suction cup to engage a component of a set, said assembly having a plurality of lateral sides; directional jaws movably mounted on said support adjacent to all sides of the assembly of suction cups; and means for moving said jaws against the components of a set which is about to be lifted by said suction cups so that the jaws rearrange the components of an array wherein the distribution of components deviates from a desired distribution and the jaws move away from the rearranged components before the suction cups release the rearranged components of the set.

2. The apparatus of claim 1, wherein said arm is a cantilever arm and said suction lifter further comprises a suction generating device, a manifold provided in said support and communicating with the bellows of said suction cups, means for connecting said device with said manifold, and a shutoff valve provided in said connecting means and operable to interrupt the connection between said manifold and said device.

3. The apparatus of claim 1, wherein each of said bellows has an outer end remote from said support and the turning points for angular movability of said bellows form rings and are adjacent to the respective outer ends.

4. The apparatus of claim 1, wherein each of said bellows is axially compressible to at least 50% of its original length.

5. The apparatus of claim 1, further comprising stabilizing elements on said bellows.

6. The apparatus of claim 1, wherein each of said bellows has an outer end remote from said support and each of said suction cups further comprises a sealing ring of soft elastomeric material provided on and located in the region of the outer end of the respective bellows.

7. The apparatus of claim 6, wherein said bellows comprise a material which is stiffer than the material of said sealing rings.

8. The apparatus of claim 1, wherein each of said bellows has a minimal internal cross-sectional area such that the effective suction cross-sectional area is ensured in each position of the bellows.

9. The apparatus of claim 8, wherein each of said bellows has an inner end nearer to and an outer end remote from said support, the suction cross-sectional area of each bellows corresponding to the type of weight and each bellows having an attachment surface area which extends without constrictions from the inner to the outer end of the respective bellows.

10. The apparatus of claim 1, wherein each of said bellows has an inner end adjacent to and an outer end remote from said support; and further comprising an axially shiftable cylinder in each of said bellows, the cross-sectional area of each of said cylinders corresponding to the suction cross-sectional area of the respective bellows and each of said cylinders having an end provided with a sealable opening and located at the inner end of the respective bellows.

11. The apparatus of claim 1, wherein each of said bellows has a throttle.

12. The apparatus of claim 11, wherein each of said throttles constitutes a constriction in the interior of the respective bellows.

13. The apparatus of claim 1, wherein each of said bellows has an inner end adjacent to and an outer end remote from said support, each of said outer ends having a circumferential groove and each of said sucion cups further comprising a sealing ring, each of said sealing rings comprising a relatively stiff portion which is received in the respective groove by snap action and at least one relatively soft annular sealing lip engageable with a component of a paving set.

14. The apparatus of claim 13, wherein each of said sealing rings comprises several substantially concentric annular sealing lips having different heights.

15. The apparatus of claim 38, wherein the sealing lips of each of said sealing rings include an outer lip and at least one inner lip surrounded by the respective outer lip, the height of said outer lips exceeding the height of the respective inner lips.

16. The apparatus of claim 13, wherein each of said sealing lips has a substantially conical cross-sectional outline.

17. The apparatus of claim 1, wherein each of said bellows has an inner end nearer to and an outer end more distant from said support, each of said bellows having a plurality of pleats having different diameters and including a maximum-diameter pleat adjacent to the respective outer end.

18. The apparatus of claim 1, wherein each of said bellows has at least one wall portion of greater flexibility and at least one wall portion of lesser flexibility.

19. The apparatus of claim 1, wherein each of said bellows has an end which is remote from said support; and further comprising suction chambers each connected to the outer ends of several bellows and arranged to contact and attract the components of a paving set.

20. The apparatus of claim 19, wherein each of said suction chambers has a suction shoe and several nipples each connected to one of the respective bellows.

21. The apparatus of claim 19, wherein each of said chambers has a relatively small height and is provided with orifices which establish communication with the interior of the respective bellows.

22. The apparatus of claim 19, wherein each of said chambers has a sealing lip which contains a soft elastomeric material and is arranged to contact the components of a paving set.

* * * * *